US006484989B1

(12) United States Patent
Connery

(10) Patent No.: US 6,484,989 B1
(45) **Date of Patent: *Nov. 26, 2002**

(54) HIGHCHAIR HELPER

(76) Inventor: Mente Connery, 632 E. Amelia St., Orlando, FL (US) 32803

( * ) Notice: Subject to any disclaimer, the term of this patent is extended or adjusted under 35 U.S.C. 154(b) by 0 days.

This patent is subject to a terminal disclaimer.

(21) Appl. No.: 09/653,879

(22) Filed: Sep. 1, 2000

Related U.S. Application Data

(63) Continuation-in-part of application No. 09/138,889, filed on Aug. 24, 1998, now Pat. No. 6,119,996.

(60) Provisional application No. 60/090,373, filed on Jun. 22, 1998.

(51) Int. Cl.[7] ..... A47K 1/08

(52) U.S. Cl. ..... 248/311.2; 108/26; 108/46; 108/47; 224/482; 248/214; 297/153; 297/182; 297/188.2

(58) Field of Search ..... 248/311.2, 312, 248/312.1, 313, 214, 215, 309.1, 225.11, 225.21; 108/44, 45, 46, 47, 24, 25, 26; 297/188.2, 188.18, 174, 153, 182; 224/276, 282, 281, 482

(56) References Cited

U.S. PATENT DOCUMENTS

| | | | | |
|---|---|---|---|---|
| 1,660,743 A | | 2/1928 | Carroll | |
| 1,786,902 A | | 12/1930 | Doughty, Jr. | |
| 1,937,994 A | | 12/1933 | Taylor | 45/75 |
| D154,271 S | | 6/1949 | Heim | D15/1 |
| 2,707,141 A | | 4/1955 | Witter | 311/103 |
| 2,711,872 A | | 6/1955 | Lampke | 248/103 |
| 3,143,374 A | | 8/1964 | Carboni | 297/188 |
| D208,317 S | | 8/1967 | Broder | D44/10 |
| 3,338,628 A | | 8/1967 | Evans | |
| 3,475,052 A | | 10/1969 | Kaposi | 297/153 |
| 3,829,113 A | | 8/1974 | Epelbaum | 280/30 |
| 3,904,041 A | | 9/1975 | Medgebow | 211/72 |
| 4,261,294 A | * | 4/1981 | Bescherer | 119/57.8 |
| 4,403,786 A | | 9/1983 | Ulics | 280/289 WC |
| 4,548,440 A | | 10/1985 | Meslin et al. | 297/174 |
| 4,560,128 A | | 12/1985 | Willeby et al. | 248/230 |
| 4,606,576 A | | 8/1986 | Jones | 297/153 |
| D298,019 S | | 10/1988 | McMillen | D12/129 |
| 4,795,209 A | | 1/1989 | Quinlan, Jr. et al. | 297/153 |
| 4,854,638 A | | 8/1989 | Marcus et al. | 297/250 |

(List continued on next page.)

*Primary Examiner*—Anita King
*Assistant Examiner*—Tan Le
(74) *Attorney, Agent, or Firm*—Brian S. Steinberger; Law Offices of Brian S. Steinberger, P.A.

(57) ABSTRACT

Detachable bottle and food holding subtrays and clamps for attaching onto the raised ridge edges on trays used in highchairs, strollers, booster chairs, and activity chairs. The clamps can be a single component having a curved upper flange for fitting about the raised ridge of the existing tray, and an upper bent flange having an end which abuts against a lower surface of the tray. Dual cylindrical bottle subtray holders and flat planar food subtray holders can snap onto the clamp leaving the bottles and food in the subtrays at a lower level than that of the tray out of reach of a sitting child. Another clamp has a general C-shape with either a screwable post or spring biased post locking the clamp to the raised edge of the existing tray. Another clamp has plural clip portions for attaching the subtray holders. The subtray holders can also include removable lids that snap over food dish openings and removable resilient rings for adjusting the diameter of openings in the subtrays to be able to hold different diameter sized bottles, glasses and jars.

14 Claims, 9 Drawing Sheets

U.S. PATENT DOCUMENTS

| | | | | | |
|---|---|---|---|---|---|
| 4,858,796 | A | | 8/1989 | Roth | 224/42.44 |
| D303,454 | S | | 9/1989 | Morales et al. | D3/40 |
| 4,927,024 | A | | 5/1990 | Lloyd | 206/562 |
| 4,961,555 | A | | 10/1990 | Egan, Jr. | 248/231.8 |
| 4,968,092 | A | | 11/1990 | Giambrone | 297/151 |
| 5,106,003 | A | * | 4/1992 | Ma | 224/311 |
| 5,106,046 | A | | 4/1992 | Rowles et al. | 248/311.2 |
| 5,108,059 | A | | 4/1992 | Curtis | 248/146 |
| 5,114,108 | A | * | 5/1992 | Olschansky | 248/311.2 |
| 5,143,335 | A | | 9/1992 | Frankel | 248/215 |
| 5,148,755 | A | | 9/1992 | Morales | 108/47 |
| 5,170,981 | A | | 12/1992 | Lin | 248/311.2 |
| 5,211,607 | A | | 5/1993 | Fermaglish et al. | 472/15 |
| 5,244,175 | A | | 9/1993 | Frankel | 248/215 |
| 5,257,765 | A | | 11/1993 | Halle | 248/222.1 |
| 5,279,452 | A | | 1/1994 | Huynh | 224/42.45 R |
| 5,317,977 | A | * | 6/1994 | Omessi | 108/97 |
| 5,413,035 | A | * | 5/1995 | Fernandez | 108/44 |
| 5,419,265 | A | * | 5/1995 | Zimmerman | 108/45 |
| 5,437,493 | A | | 8/1995 | Weisleder | 297/150 |
| 5,458,394 | A | | 10/1995 | Nichols | 297/173 |
| 5,480,211 | A | | 1/1996 | Douglas et al. | 297/174 |
| 5,489,075 | A | | 2/1996 | Ible | 248/104 |
| 5,503,297 | A | | 4/1996 | Frankel | 220/751 |
| 5,586,800 | A | | 12/1996 | Triplett | 297/148 |
| 5,603,479 | A | | 2/1997 | Kristy | 248/548 |
| 5,613,657 | A | | 3/1997 | Olaiz | 248/102 |
| 5,624,095 | A | | 4/1997 | Zissu | 248/231.81 |
| 5,660,432 | A | | 8/1997 | Davis | 297/182 |
| 5,667,119 | A | * | 9/1997 | Florence | 224/482 |
| 5,704,576 | A | | 1/1998 | Meeker | 248/214 |
| 5,996,507 | A | | 12/1999 | Joseph | 108/46 |
| 6,095,060 | A | * | 8/2000 | Ma | 108/45 |
| 6,119,996 | A | * | 9/2000 | Connery | 248/311.2 |
| 6,283,042 | B1 | * | 9/2001 | Wargo et al. | 108/296 |
| 6,290,063 | B1 | * | 9/2001 | Vogt et al. | 248/311.2 X |
| 6,298,793 | B1 | * | 10/2001 | Turner et al. | 108/26 |

* cited by examiner

HIGHCHAIR HELPER

This invention relates to highchairs and strollers, and in particular to a detachable device for attaching to tray edges on highchairs, booster chairs, activity chairs and stroller type chairs for holding baby bottles, food and the like, out of reach of a sitting child, instead of using existing table and countertop surfaces. This invention is a Continuation-in-part of application Ser. No. 09/138,889 filed Aug. 24, 1998 U.S. Pat. No. 6,119,996, which has now been allowed, which claims the benefit of priority to U.S. Provisional application No. 60/090,373 filed Jun. 22, 1998.

BACKGROUND AND PRIOR ART

Feeding a baby can be extremely messy. When using a traditional highchair for feeding, the person feeding the seated infant usually must handfeed the infant holding the jar of food in one hand, while spoon feeding the baby with the other hand. This handholding of the food jar is necessary since the infant has a tendency to reach across the tray width, and knock the objects within their reach. Knocked down jars of baby food can be extremely messy to clean up, as well as resulting in wasted unusable food spilled out from the jar. Additionally, the person feeding the infant must use both of their hands at all times during the feeding process.

Additionally, the feeding of infants also requires a baby bottle filled with milk, juice and the like, to be used. For similar reasons, the baby bottles cannot be temporary stored on the existing tray since the bottles are within easy reach of the infant and can be knocked down creating additional messes and wasted liquids. The problem comes into play when the person feeding the infant must temporarily place the bottle somewhere if they are going to start hand feeding the infant using a handheld food jar, bowl and handheld spoon.

Similar problems occur with other chairs having trays such as infant booster chairs, stroller type chairs, stationary and movable activity chairs, and the like.

To obviate the problems above, the person feeding the infant has had to temporarily place the bottle, food jar, and/or spoon oil floor surfaces, adjacent tables and/or countertops. However, this temporary solution creates other problems. In addition to taking up additional space, these surfaces need to be completely clean (bacteria and bug free) to store these objects, and generally require an extra cleanup after the jars, bottles, and spoons have been placed on these surfaces.

Various proposals have been made over the years but fail to solve the problems presented above. U.S. Pat. No. Des. 208,317 to Broder; U.S. Pat. No. 3,143,374 to Carboni; U.S. Pat. No. 3,475,052 to Kaposi; and U.S. Pat. No. 4,548,440 to Meslin et al. each describe attaching small plate trays to existing highchair trays. However, each of these references requires placing the small plate trays on top of the existing tray putting the small plate trays within easy reach of the infants, and not solving any of the problems presented above.

U.S. Pat. No. 2,711,872 to Lampke describes a telescoping arm with a clamp end for use with baby crib railings. However, Lampke's clamp cannot be used to attach their device over and about the top raised lip edges and bottom of the tray edge on traditional highchair and stroller trays. Furthermore, the arm and clamp mechanism can be potentially harmful to the infant if left unattended.

U.S. Pat. No. 1,660,743 to Carroll; U.S. Pat. No. 1,937,994 to Taylor; and U.S. Pat. No. 2,707,141 to Witter each describe tray attachment devices for attaching to the edges of tables. However, none of these patents has a clamp that allows the device to simultaneously wrap about the top raised lip edge and bottom edge on traditional highchairs and stroller trays. Using these devices would create unstable tray attachments. Furthermore, these devices would leave the food jars and bottles at the same height as that of the existing trays themselves. Thus, objects stored on these devices would still be within reach of seated infants.

Other patents of interest that also fail to overcome all the deficiencies to the prior art include U.S. Pat. No. Des. 303,454 to Morales et al.; U.S. Pat No. 3,338,628 to Evans; U.S. Pat No. 3,904,041 to Medgebow; U.S. Pat. No. 4,403,786 to Ulics; U.S. Pat. No. 4,854,638 to Marcus et al.; U.S. Pat. No. 4,858,796 to Roth; U.S. Pat. No. 5,106,046 to Rowles et al.; U.S. Pat. No. 5,148,755 to Morales; U.S. Pat. No. 5,211,607 to Fermaglish et al.; U.S. Pat. No. 5,244,175 to Frankel; U.S. Pat. No. 5,257,765 to Halle; U.S. Pat. No. 5,279,452 to Huynh; and U.S. Pat. No. 5,996,507 to Joseph.

The Morales '454 and '755 patents respectively describe a "food tray for use in vehicles", title and "utility tray for attachment to a wall, or a like", title, and are not for attaching to tray edges on high chairs and the like, and fail to overcome all the problems described above.

SUMMARY OF THE INVENTION

The primary objective of the present invention is to provide a detachable device for attaching to a tray edge on highchairs, booster chairs, and strollers for holding baby bottles, food, and the like, out of reach of a sitting child, in place of using the surfaces of adjacent tables and countertops.

The secondary objective of this invention is to provide a detachable device that can be easily attached and removed to all tray edges on existing highchairs, booster chairs and strollers.

The third objective of this invention is provide an attachment device for the trays on highchairs, booster chairs and strollers that reduces the spillage of foods/liquids during infant feeding.

The fourth objective of this invention is to provide an attachment device for the trays on highchairs and strollers that allows bottles and food jars to be cleanly and safely stored when attached to the tray and when stored off the tray in a refrigerator, and the like.

The fifth objective of this invention is to provide an attachment device for the trays on highchairs and strollers that can easily be cleaned within a dishwasher, and used within a microwave.

The sixth objective of this invention is to provide an attachment device for trays on highchairs and strollers that have an adjustable opening for securing different diameter bottles.

The seventh objective of this invention is to provide an attachment device for trays on highchairs and strollers that have a removable lid for covering food and liquid.

The eighth objective of this invention is to provide an attachment device for trays on highchairs and strollers that can be separately positioned to a tray surface by removable suction cup type fasteners.

A preferred embodiment of the detachable device includes a clamp having an upper portion for attaching about an upper raised ridge of a tray situated in front of a sitting child, a lower portion for abutting against a lower surface of the tray, and an exterior side having brackets for allowing a bottle holder subtray or a food subtray to be attached thereto. The tray can be part of an existing highchair, a stroller, a booster chair and an activity chair. The upper portion of the clamp can include a planar plate extending over the raised ridge of the tray and a downwardly protruding portion for contacting a surface of the tray inside the raised ridge. The lower portion of the clamp can further include either a screwable post fastener that can abut up against the lower surface of the tray, or a spring biased post fastener.

Another version of the clamp can include a curved flange having a generally C-cross-sectional shape with a channel opening in the flange for wrapping about the raised edge of the tray, a side wall having an upper end connected to the flange, the side wall being adjacent to an exterior surface of the raised edge of the tray, and an upwardly bending flange connected to a lower end of the sidewall, the upwardly bending flange having a portion which abuts against the lower surface of the tray, wherein the clamp means snaps into a lock position about the raised edge and the lower surface of the tray.

A removable shield can be inserted between the bottle/food holder subtrays and the clamps for blocking the sitting child from reaching the food and the liquid. The food subtray can include a substantially flat subtray having raised side edges, and a rear wall perpendicular to the subtray, the rear wall having an upper hook end for attaching to a receiving portion in the exterior wall of the clamp means, the rear wall having a lower end connected to the subtray, wherein the subtray is at a lower level than that of the tray. The bottle holder subtray can include a substantially flat subtray having openings for supporting a baby bottle therein, and a rear wall perpendicular to the subtray, the rear wall having an upper hook end for attaching to a receiving portion in the exterior wall of the clamp means, the rear wall having a lower end connected to the subtray, wherein the subtray is at a lower level than that of the tray. The bottle hold subtray can further include dual cylinders openings for supporting a baby bottle therein, and a real wall perpendicular to the dual cylinders, the rear wall having an upper hook end for attaching to a receiving portion in the exterior wall of the clamp means, the rear wall having a lower end connected to the dual cylinders, wherein the dual cylinders are at a lower level than the tray.

The invention can further use removable lids for covering food dish openings in the subtray, and removable ring type inserts for adjusting the diameter of openings being used to hold glasses, bottles and jars. Furthermore, the invention can use another attachment device such as suction cups which allow the subtrays to adhere on the surface of tables, countertops, and even to the main tray surface itself.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figures 1, 2:
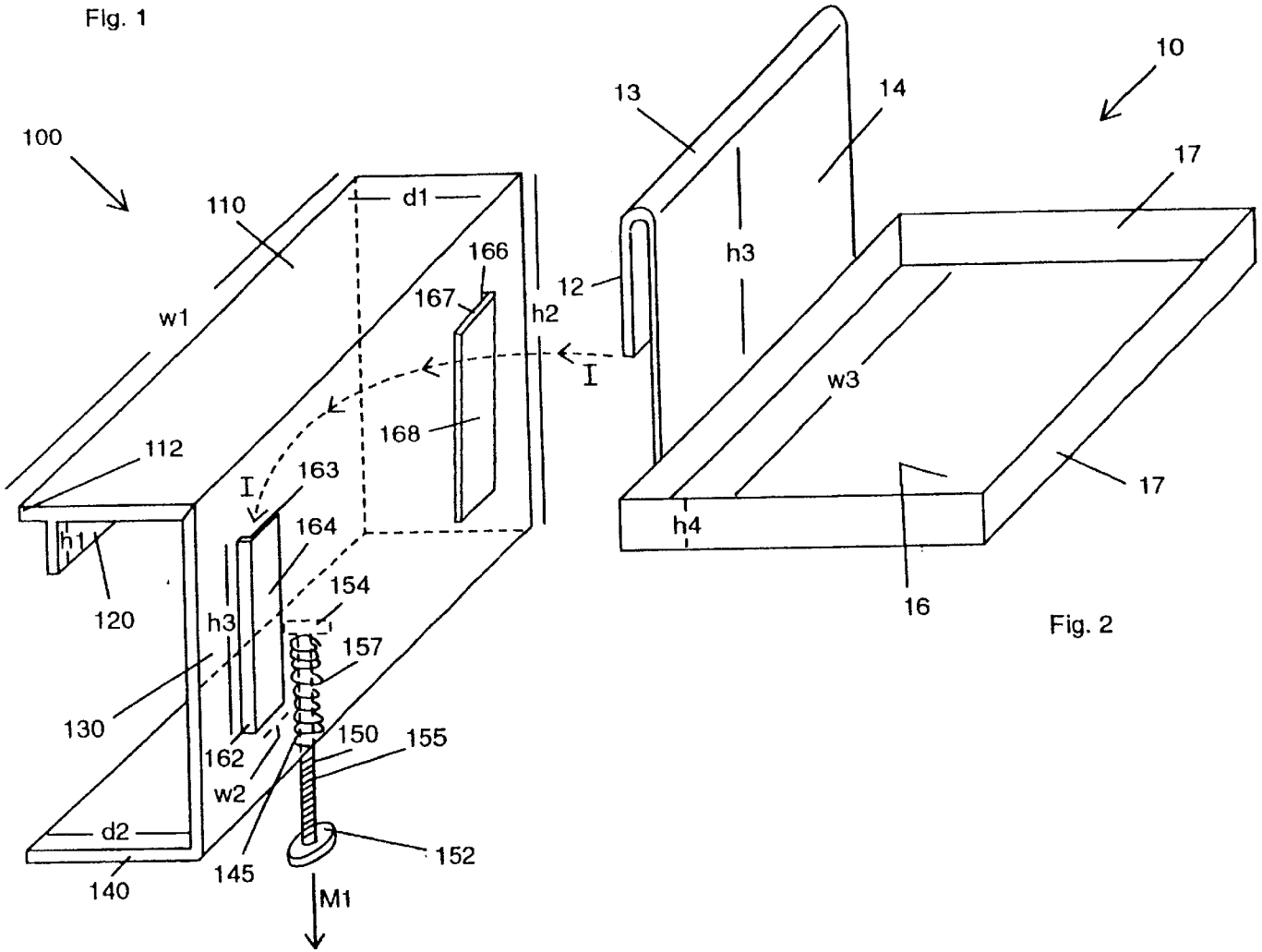
FIG. 1 is a perspective view of a first preferred embodiment of the tray edge adjustable clamp of the subject invention for use with trays on highchairs, booster chairs, activity chairs and strollers.
FIG. 2 is a perspective view of a food subtray attachment for use with the edge clamp of FIG. 1.

FIG. 1 is a perspective view of a first preferred embodiment 100 of the tray edge adjustable clamp of the subject invention for use with trays on highchairs, booster chairs, activity chairs and strollers. Clamp 100 includes an upper planar horizontal plate 110 having a width W1, of approximately 4 and ¼ inches, a depth d1, of approximately 1 and ½ inches. Perpendicular to plate 110 is a downwardly projecting lip 120 has a height h1, of approximately ½ an inch, which is approximately ½ inch inside of upper plate edge 112, grips about an upper raised ridge of tray which is shown in greater detail in later described drawings. Perpendicular to a rear edge of horizontal plate 110 is a vertical plate 130 having a height h2, of approximately 3 inches. On the exterior side of vertical plate 130 are dual L-shaped brackets 162, 164 and 166, 168. Each bracket has vertical side portions 162, 166 having a height h3 of approximately 1 and ½ inches, with inwardly projecting clip walls 164, 166 having a width W2 of approximately 1 inch, and having open channels 163, 167 formed therebetween. Perpendicular to vertical plate 130 is bottom plate 140 (which is parallel to upper plate 110), having a depth d2, of approximately 1 and ½ inches. A post 150 is inserted within a middle portion of bottom plate 140, and has an upper flattened end 154 which can have a expandable spring 157 between flattened end 154 and upper surface of bottom plate 140. On the opposite end of post 152 is a second flattened end 152 which can be moved by the user downward in the direction of arrow M1 so that clamp 100 is fit about tray edges of the highchair, stroller, activity chairs and booster chair which are shown and described in the other figures. Alternatively, post 150 can have threads 155 which allow the post to be screwed through bottom opening 145 within plate 140.

FIG. 2 is a perspective view of a food subtray attachment 10 for use with the edge clamp 100 of FIG. 1. Referring to FIG. 2, subtray 10 includes a hook portion 13 and downwardly protruding end-wall 12 having a substantially C-cross-sectional shape. Attached to hook portion 12–13 is a rear wall 14 having a height h3, of approximately 2 to approximately 3 inches, with a planar plate subtray 16 perpendicularly attached thereto. Plate subtray 16 can have a width W3, of approximately 3 to approximately 5 inches and four vertical sidewalls 17 each having a height h4 of approximately ¼ to ½ of an inch. To use, end-wall 12 is inserted in the direction of arrow 11 into channel openings 163, 167 until the undersurface of hook top 13 abuts against the top edges of clip walls 164, 168. The bottom surface 16 of FIG. 2 can support the bottom of bottles, jars and bowls as well as be able to directly hold food and/or liquids therein.

Figure 3A:
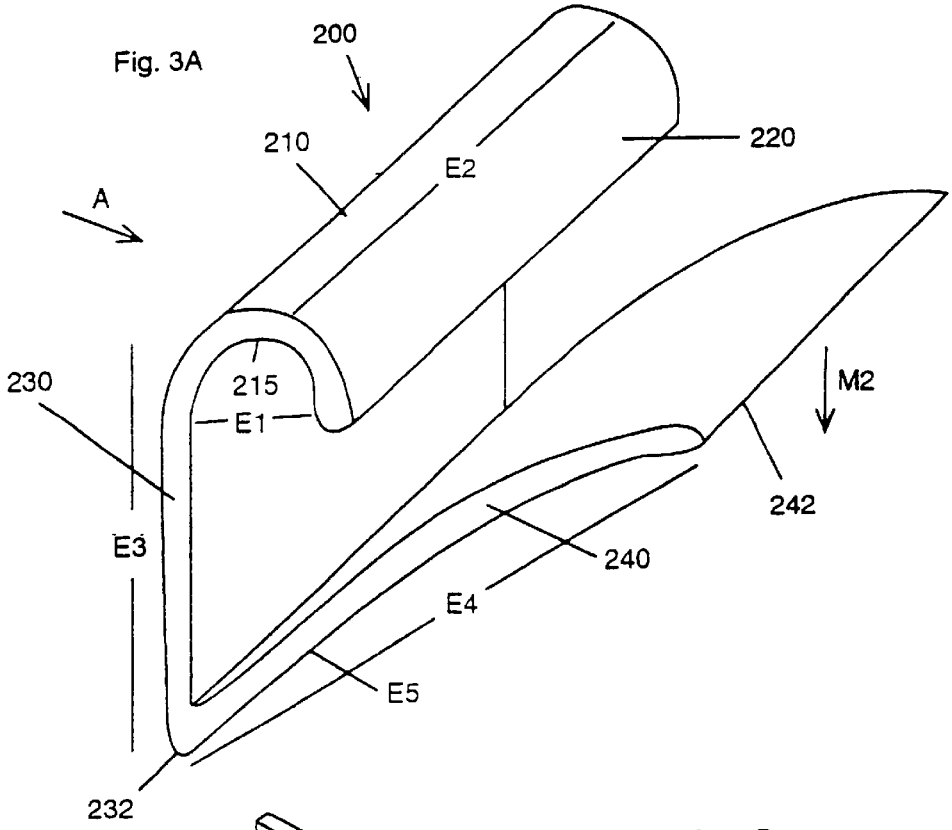
FIG. 3A is a perspective view of a second preferred embodiment of the tray edge expandable clamp of the subject invention for use with trays on highchairs, booster chairs, activity chairs and strollers.

FIG. 3A is a perspective view of a second preferred embodiment 200 of the tray edge expandable clamp of the subject invention for use with trays on highchairs, booster chairs, activity chairs and strollers. Referring to FIG. 3A, expandable clamp 200 includes downwardly curved flange 210 with rounded lip tip 220 attached to a rear wall 230. The diameter E1 between lip 220 and rear wall 230 being approximately 1 inch in diameter. On the exterior side of rear wall 30 are dual clip brackets 262, 264, 268, which correspond to like components in the preceding figures. Small inwardly protruding dimples 261, 269 allow the subtray attachments to have a tighter fit to clamp 200. The width E2 of clamp 200 can be approximately 3 inches and the height E3 of rear wall 230 can be approximately 2 and ⅝ inches. connected to the lower end of rear wall 230 is an upwardly slightly concave bending flange plate 240 having an angle E5 of approximately 1 to 5 degrees, having an end 242 with a height E4, of approximately 1 and ¾ inches above bottom 232. End 242 can be bent down in the direction of arrow M2 when attaching the clamp 200 about the tray edges in the applications to be later describes.

Figure 3B:
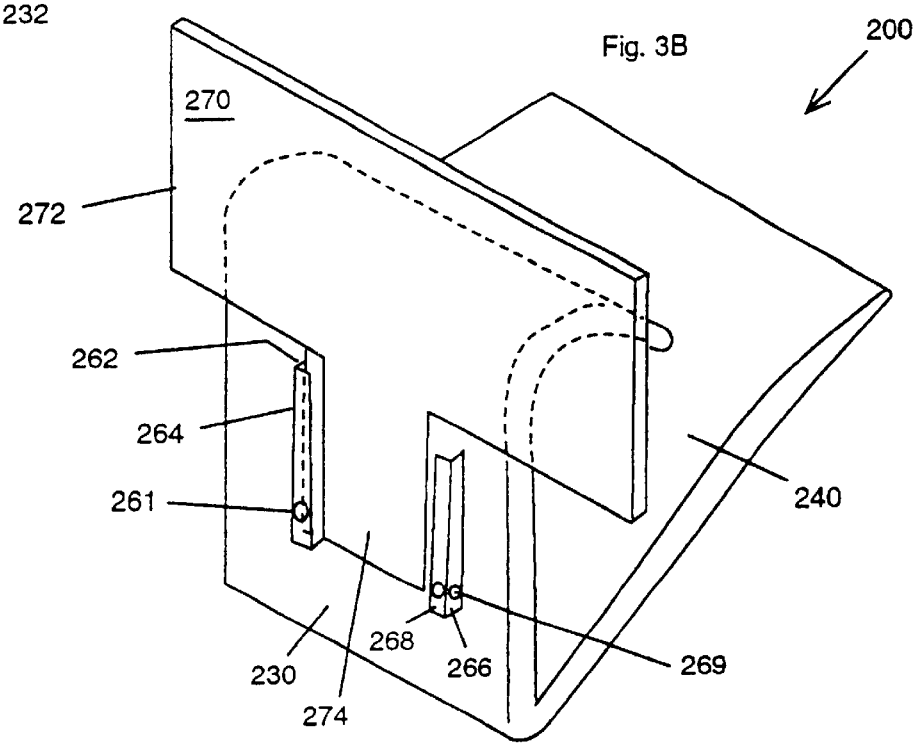
FIG. 3B is a rear view of the expandable clamp of FIG. 3A along arrow A, with a removable shield.

FIG. 3B is a rear view of the expandable clamp 200 of FIG. 3A along arrow A, with a removable shield plate 270 having a general T-shape with a bottom leg 274 that is sized to fit between 264, 268 brackets. In use upper horizontal plate 272 of plate 270 aids as a shield to block a child's access to the contents of the subtrays 10, 20 and 30 described in this invention.

Figure 4:
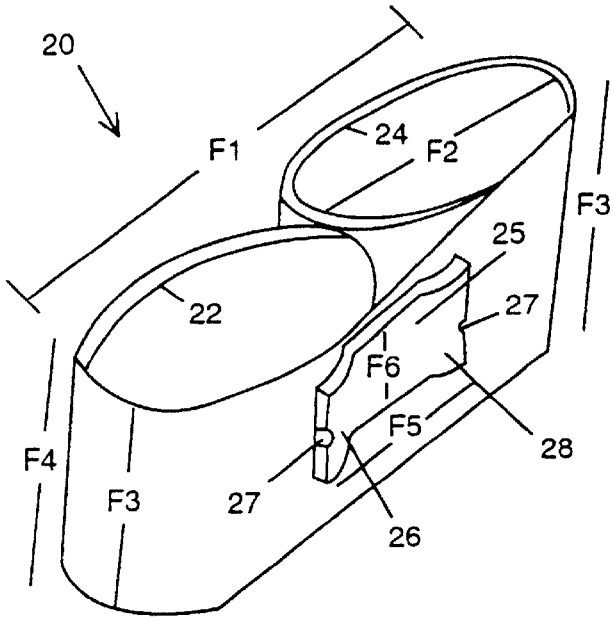
FIG. 4 is a perspective view of a bottle holder subtray attachment with mechanical lock in tab connector for use with the clamps of FIGS. 1 and 3A–3B.

FIG. 4 is a perspective view of a bottle holder subtray attachment 200 with mechanical lock in tab connector 26 for use with the clamps of FIGS. 1 and 3A–3B. Referring to FIG. 4, subtray 200 includes plastic injection molded dual side-by-side cylinders 22, 24 having a width across the front F1 of approximately 5 inches, with each cylinder having a inner diameter opening F2, of approximately 2 and ¾ inches. The side and rear heights F3 of dual cylinders 22, 24 can be approximately 2 and ½ inches, while the front height F4 of dual cylinders 22, 24 can be a rectangular tab 25 having slightly angled outwardly bent edges 26, 28 the latter having indented cut-outs 27 therein for locking about dimples 261, 269 of clamp 200 of FIGS. 3A–3B.

Figure 5:
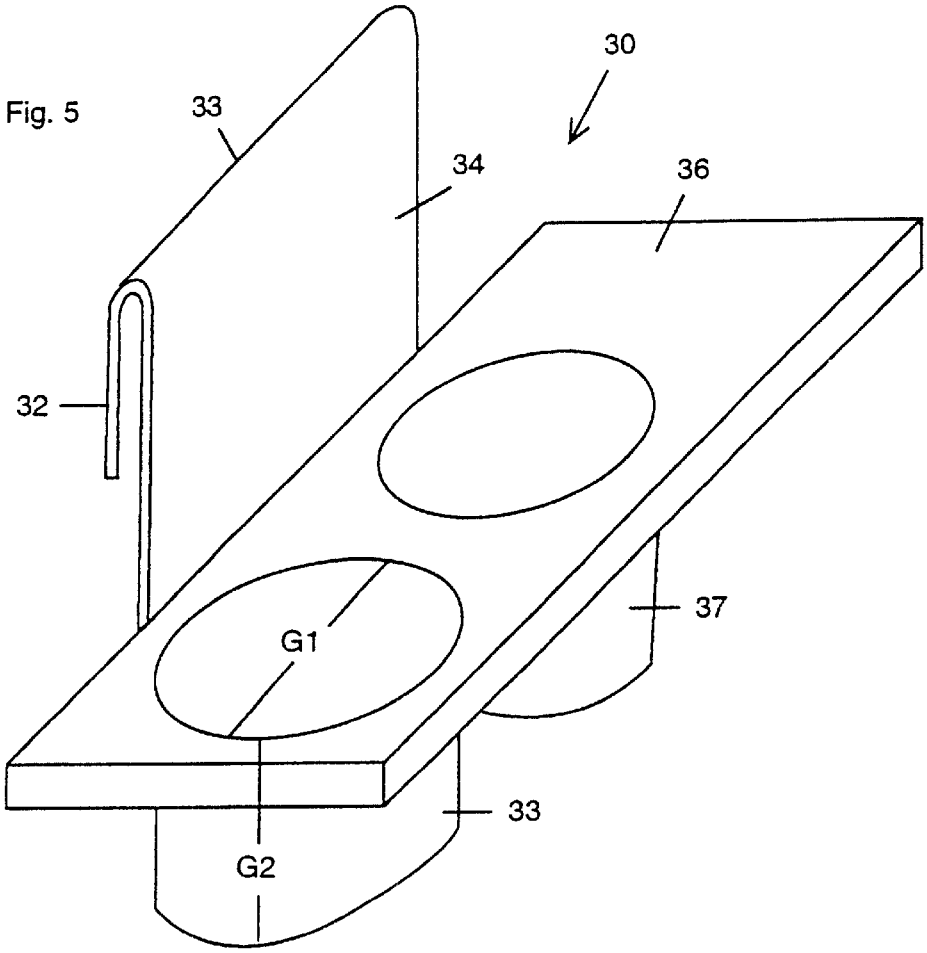
FIG. 5 is a perspective view of another bottle holder subtray attachment with hook tab connector for use with the clamps of FIGS. 1 and 3A–3B.

FIG. 5 is a perspective view of another bottle holder subtray attachment 30 with hook tab connector for use with the clamps of FIGS. 1 and 3A–3B. subtray attachment 30 includes a hook portion 33 and a downwardly protruding end wall 32 having a substantially C-cross-sectional shape. Attached to hook portion 32–33 is a rear wall 34 with a planar plate subtray 36 perpendicularly attached thereto and having dimensions similar to those of FIG. 2. Referring to FIG. 5, plate subtray 36 includes cylinders 33, 37 the latter having similar dimensions to cylinders 22, 24 described in reference to FIG. 4. To use end wall 22 of attachment 30 is inserted in the direction of arrow 11 into channel openings 163, 167 shown in FIG. 1 or within brackets 264, 268 shown in FIGS. 3A–3B.

Figure 6:
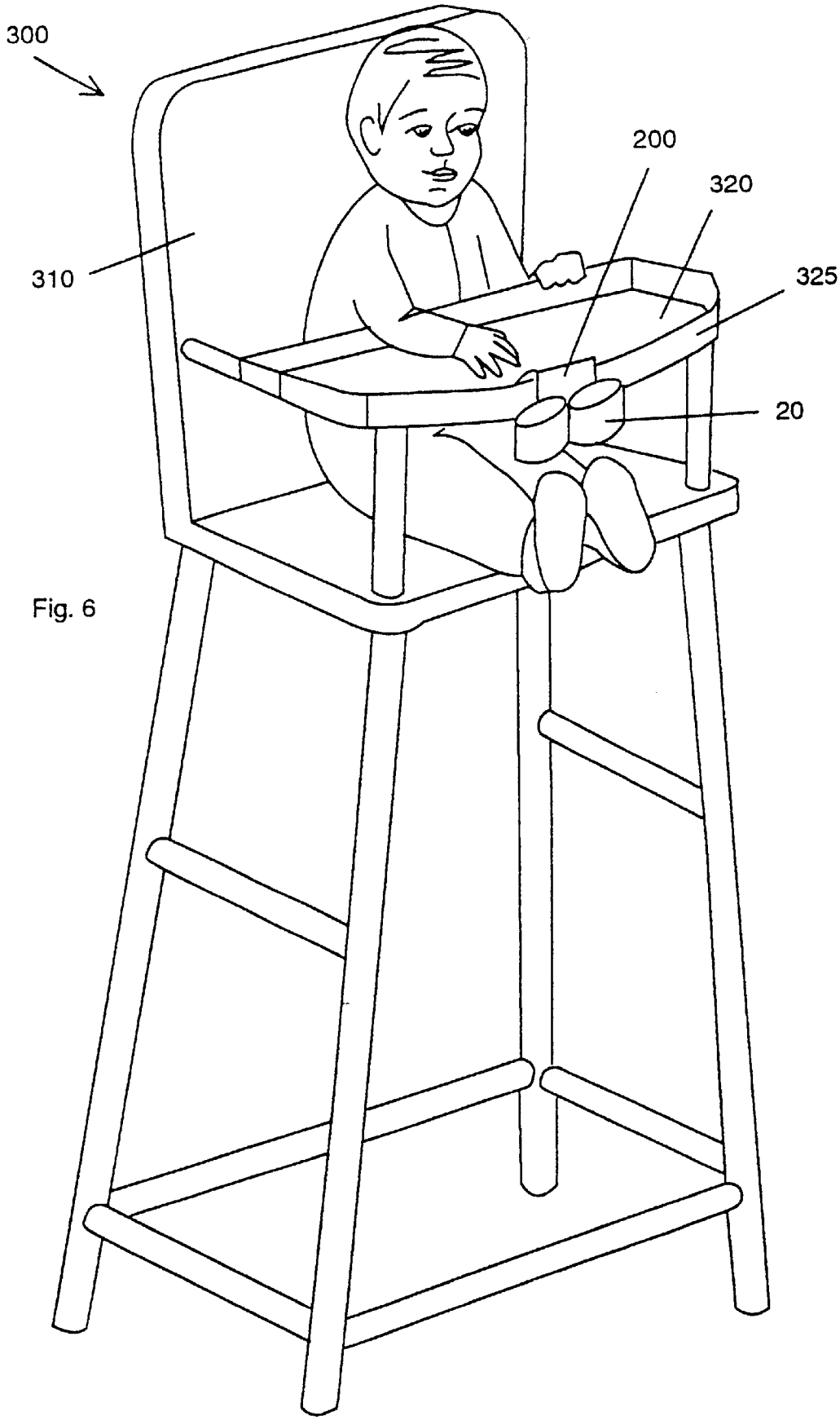
FIG. 6 is a perspective view of the bottle holder subtray attachment of FIG. 4 supported by the clamps of FIGS. 1 and 3 attached to a tray on a highchair.

FIG. 6 is a perspective view 300 of the bottle holder subtray attachment 20 of FIG. 4 supported by the clamp 200 of FIGS. 1 and 3 attached to a raised edge 325 of a tray 320 on a highchair 310.

Figure 7:
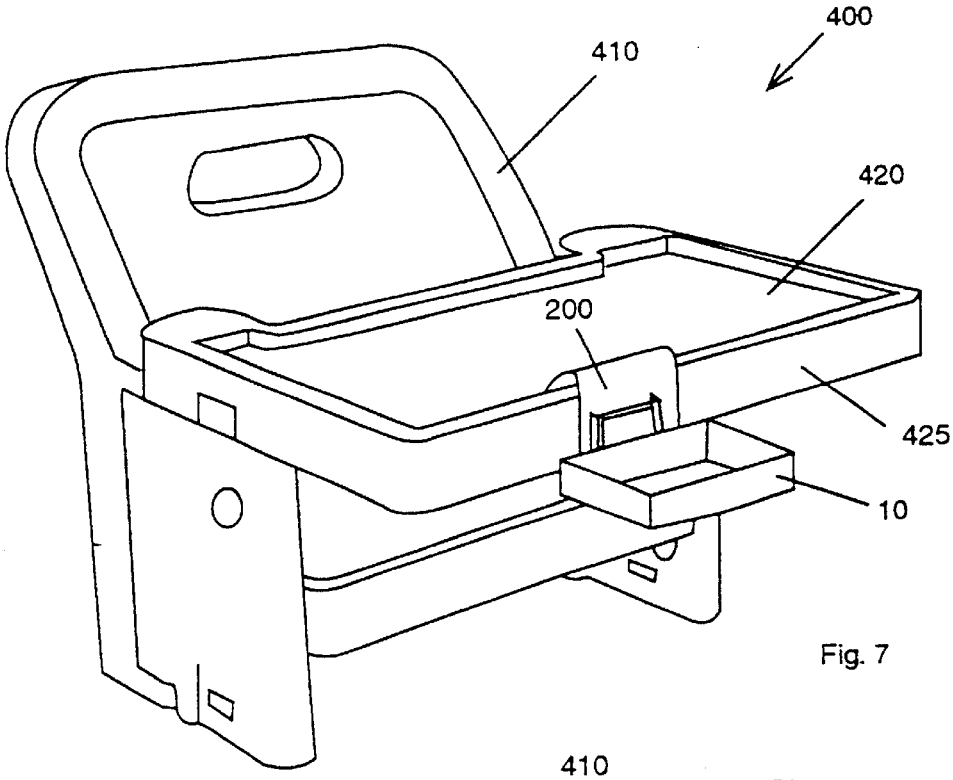
FIG. 7 shows the attachment clamp of FIG. 3A with the food subtray of FIG. 2 attached to a booster chair.

FIG. 7 is a perspective view 400 of the attachment clamp 200 of FIG. 3A with the food subtray 10 of FIG. 2 attached to a raised edge 425 of tray 420 on a booster chair 410.

Figure 8:
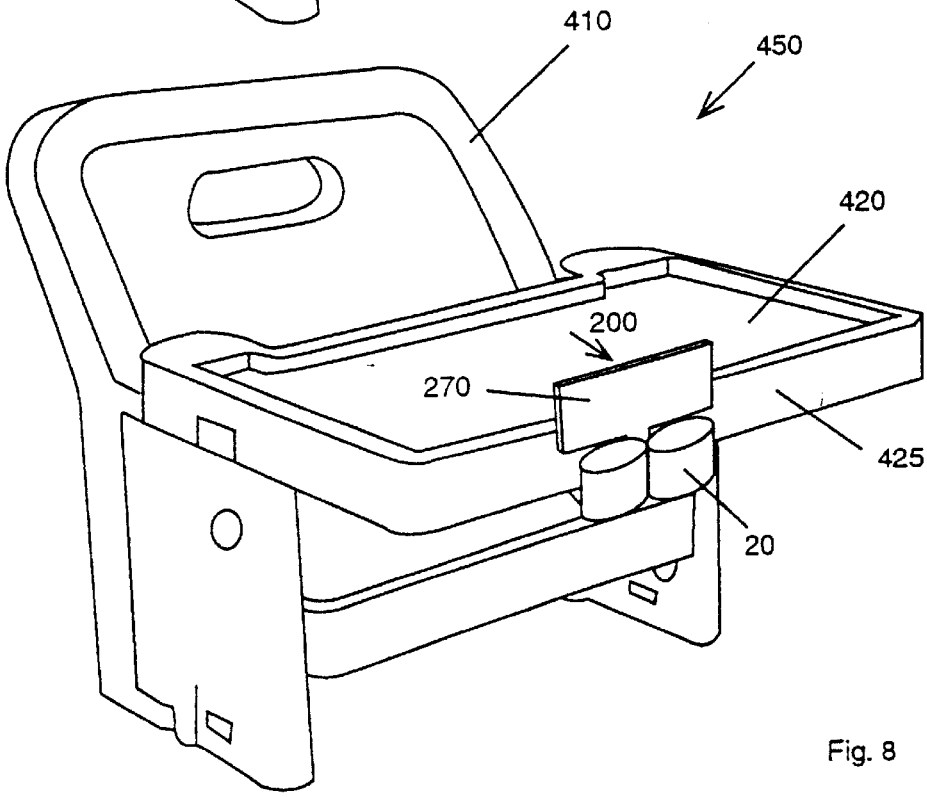
FIG. 8 is a perspective view of the attachment clamp and shield of FIG. 3B with the dual cylinder bottle holder of FIG. 4 attached to a booster chair.

FIG. 8 is a perspective view of 450 of the attachment clamp 200 and shield 270 of FIG. 3B with the dual cylinder bottle holder 20 of FIG. 4 attached to a raised edge 425 of tray 420 on a booster chair 410. Removable shield 270 slides between dual cylinder holder 20 and clamp 200 when used.

Figure 9:
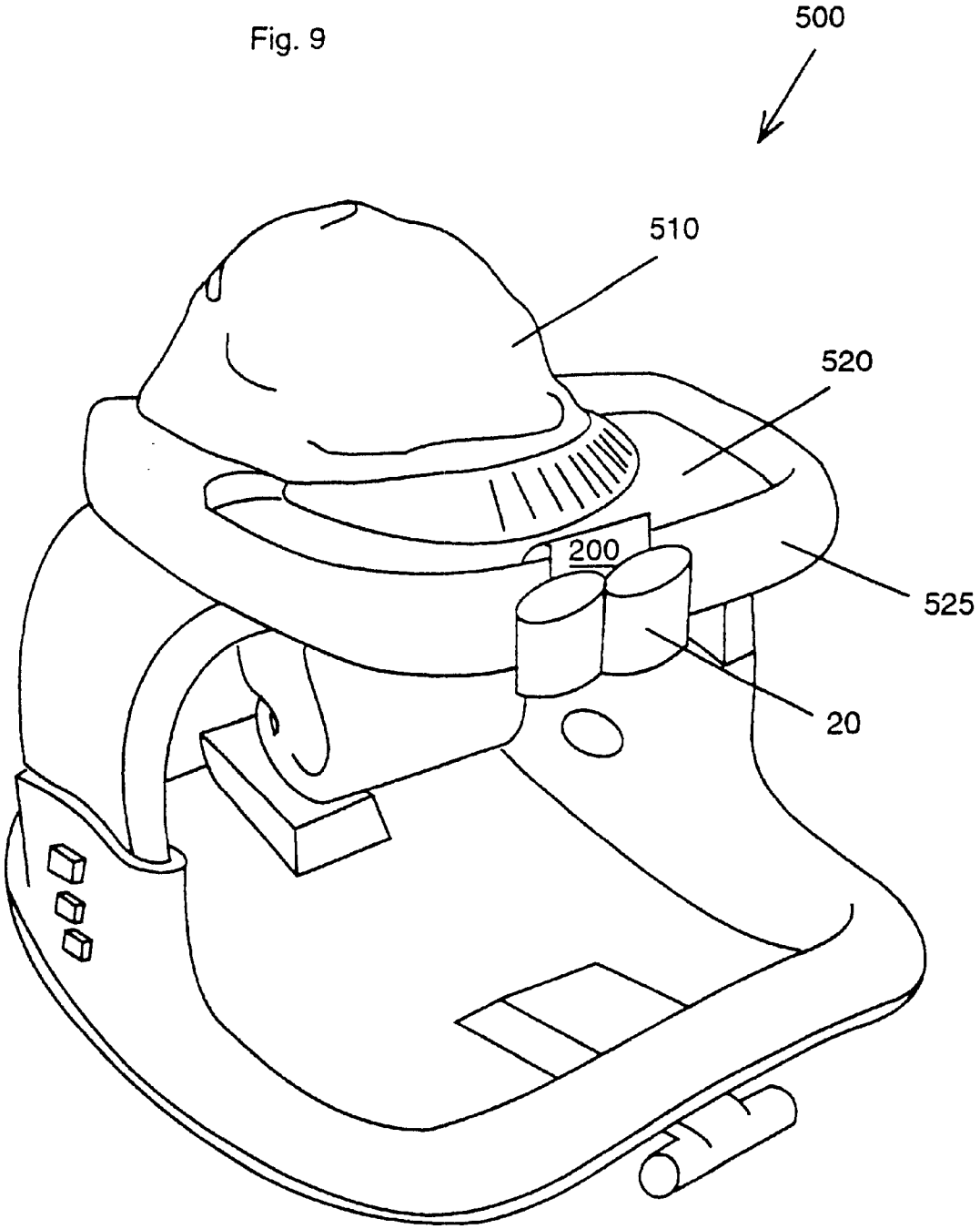
FIG. 9 is a perspective view of the attachment clamp of FIG. 3B with dual cylinder bottle holder of FIG. 4 attached to a stationary activity chair.

FIG. 9 is a perspective view 500 of the attachment clamp 200 of FIG. 3B with dual cylinder bottle holder 20 of FIG. 4 attached to a raised edge 625 of round tray 620 on a moveable activity chair 610.

Figure 10:
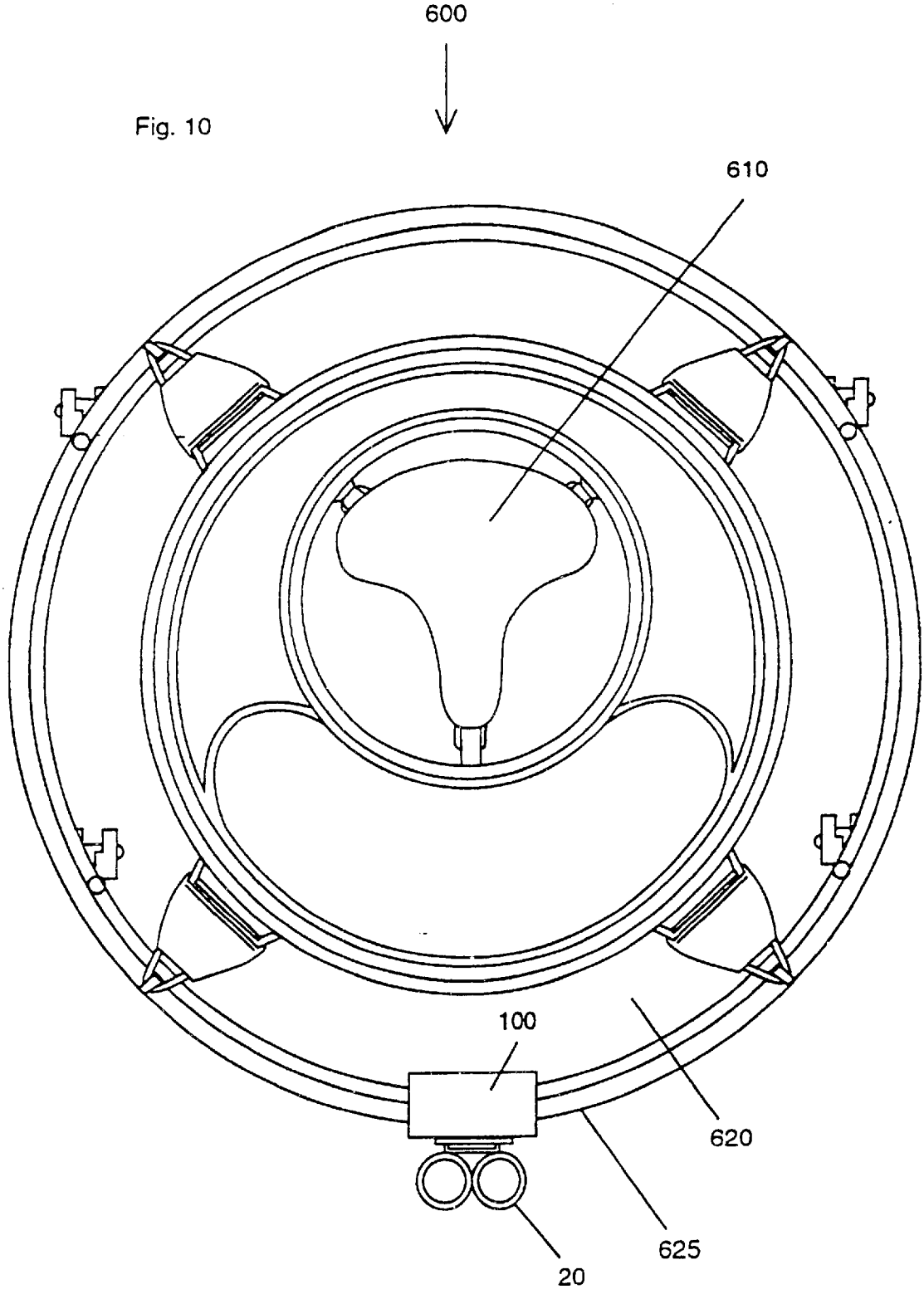
FIG. 10 is a perspective view of the attachment clamp of FIG. 1 with dual cylinder bottle holder of FIG. 4 attached to a movable activity chair.

FIG. 10 is a perspective view 600 of the attachment clamp 100 of FIG. 1 with dual cylinder bottle holder 20 of FIG. 4 attached to a raised edge 625 of round tray 620 on movable activity chair 610.

Figures 11A, 11B:
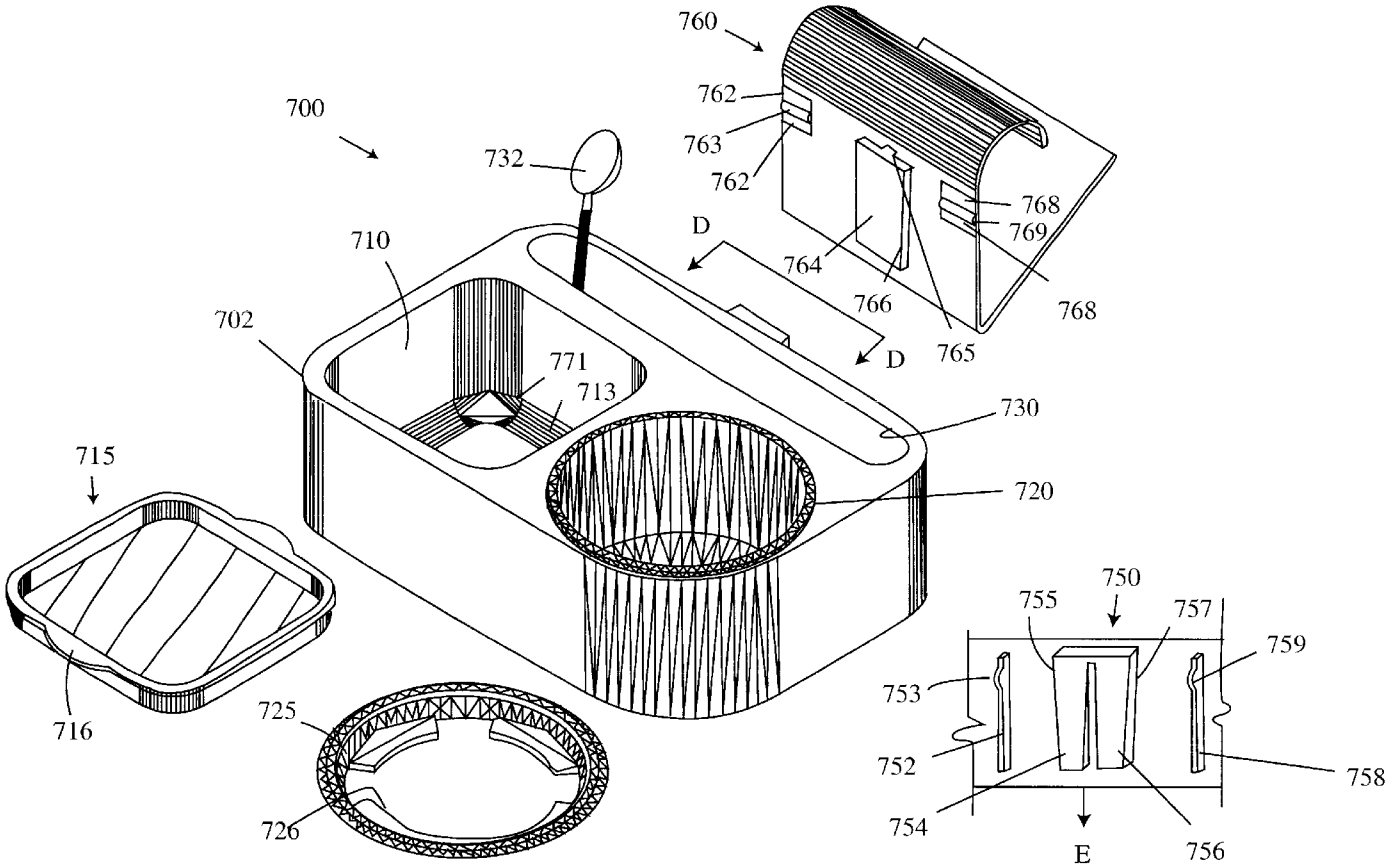
FIG. 11A is a perspective exploded view of another embodiment of the subtray attachment with separate food holder and bottle holder detached from another embodiment of the expandable clamp all detached from a food lid cover and bottle width adjuster.
FIG. 11B is a side view of the subtray attachment of FIG. 11A along arrow D.

FIG. 11A is a perspective exploded view of another embodiment 700 of the subtray attachment holder with separate food holder 710 and bottle holder opening 720 and narrow longitudinal slit 730 along a back of the holder for holding utensils and the like, therein. The holder 700 being attachable and detachable from a clamp 760 similar to those previously described. FIG. 11B is a side view of the backing clip 750 of the holder 700 of FIG. 11A along arrow D.

Referring to FIGS. 11A–11B, holder 700 can be generally rectangular with blunt and/or rounded edges 702 with an opening 710 through the top that can be square shaped with curved interior corners 711 and rounded floor portion 713 for holding food therein. A removable plastic lid 715 can snapably fit over the opening 710 and have portions 716 that can be pushed down to attach the lid and used to be pulled up to remove the lid 715. Another opening 720 in the holder 700 can be circular with or without a floor portion in order to hold liquid type beverages such as a bottle or glass therein. A removable ring 725 made of a resilient plastic material with interior protruding flexible portions can be inserted into the opening 720 to adjust the diameter of the opening to fit different diameter bottles and glasses therein. Along the top of holder 700 can be a slot such as a longitudinal slot having a bottom therein for supporting utensils 732 such as forks and spoons, and the like. Along the backwall of holder 700 are clip connectors 750 that allow the holder 700 to attach and detach from the clamp 760. Clip connectors 750 can include two vertical and raised protrusions 752, 758 each with raised upper bumps 753, 759. In between protrusions 752, 758 can be a raised male tabs 754, 756 with a slot therebetween, each male tab 754, 756 can be attached to the back of holder 700 by edges 755, 757, and each tab 754, 756 can have a wider upper portion that narrow down to a narrower lower portion that allows easy assembly about mateable clip 764–766 on clip 760. On clip 760 raised female tabs 764, 766 are attached to exterior face of clamp 760 by a central member 765 that runs between raised female tabs 764, 766. Additionally, side indentations 762, 768 are on opposite sides of the female clip tabs 764, 766, each with a horizontal raised bump portion 763, 769 thereon. During assembly, holder 700 is positioned so that male clip tabs 754, 756 are positioned above female tabs 764, 766 and moved downward in the direction of arrow E so that male tabs 754 are inserted in the space between female tabs 764, 766 and the face of clamp 760. Simultaneously, bumps 753, 759 on holder 700 snap over respective raised bumps 763, 769 and into indentations 762, 768 respectively snappably locking the holder 700 to the clamp 760.

Figures 12A, 12B:
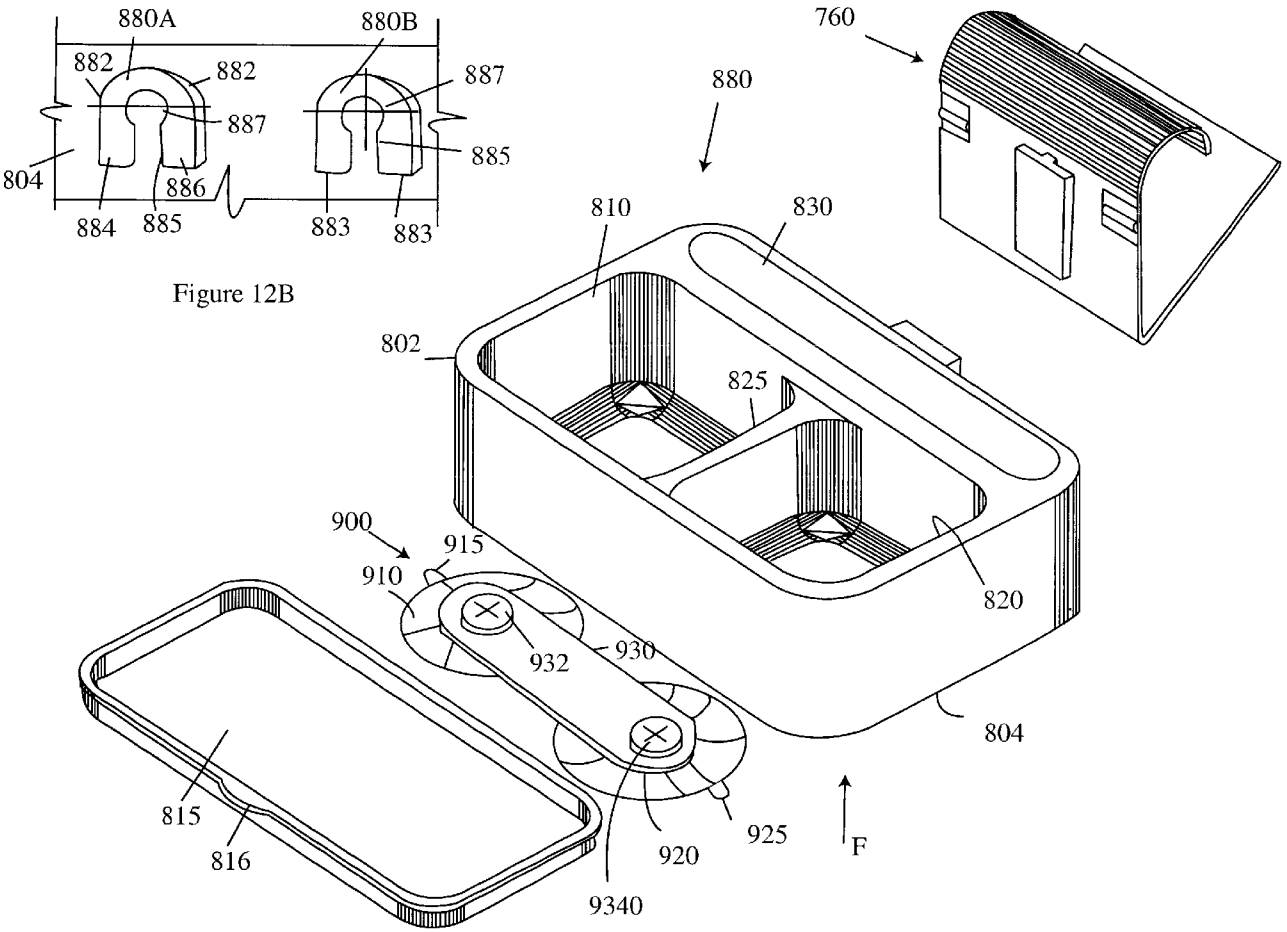
FIG. 12A is a perspective exploded view of another embodiment of the subtray attachment with dual food dishes detached from the expandable clip of FIG. 11A.
FIG. 12B is a bottom view of the subtray attachment of FIG. 12A along arrow F.

FIG. 12A is a perspective exploded view of another embodiment 800 of the subtray attachment with dual food dishes 810, 820 and utensil slot 830 detached from the expandable clip 760 of FIG. 11A. FIG. 12B is a bottom view of the subtray attachment 800 of FIG. 12A along arrow F. Subtray holder 800 can be generally rectangular with blunted and/or curved edges 802 and have utensil slot 830 similar those components in holder 700 previously described. Instead of one food dish, holder 800 can include two or more separated molded food dishes 810, 820 with a separating wall 825 therebetween slightly lower than the depth of each food dish, and one single removable lid 815 having push/pull edge 816 similar to 716 previously described. Lid 815 can be inserted over to snap onto and close off dish openings 810, 820. Underneath holder 800 can be two arc shaped fasteners 880A, 880B each being connected at their outer edges 882, and bottom edge 883 to the undersurface 804 of holder 800, and each having raised tab portions 884, 886 separated from undersurface 804 with a key shaped slot 885 therebetween. A removable fastener 900 can include two pliable type suction cups 910, 920, each having edges 915, 925 that allow the cups 910, 920 to be pulled off a surface that the suction cups are attached to. Each cup 910, 920 can be connected to one another by a pliable plastic member 930 and each cup 910, 920 has a raised central hub portion with flattened head portion 932, 934. Thus, removable fastener 900 can be pressed against any surface such as but not limited to a countertop, the tray surface, and the like, and suction cups 910, 920 pressed down to create a suction hold, followed by the circular opening 887 arc-fasteners 880A, 880B being fit about raised flat heads 932, 934 and slid along narrow opening 885 to abut against bottom wall edge 883. The components can be formed such that a tight fit exists when the holder 800 is attached to the flat heads 932, 934 on suction cups 910, 920.

The removable food and bottle holders can also include a plugable drainage hole in the bottom surface. The materials used to make the above described invention can be made from injection molded plastics, ceramic, aluminum, galvanized metal, combinations thereof, and the like, that can be easily detachable and washable within a dishwasher. If made from plastic and ceramic, the components can be useable within microwaves when the heating of food and liquid is needed, and/or used within refrigerators, and freezers.

While the invention has been described having subtray holders and various food dish openings being rectangular, the subtray holders and/or the food dish openings therein can have different shapes such as but not limited to oval, circular, triangular, polygon, and the like.

Although the embodiments describe high chairs and strollers, the invention can be used with all other types of seats having trays such as but not limited to car seats, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A detachable device holding food items for use with trays pre-attached to chairs that have sitting occupants so that the device and food items are out of reach to the sitting occupants, the device comprising in combination:

a chair having a tray attached to a front portion of the chair, the tray having a rear upper raised edge adjacent to the front portion of the chair, and an outer upper raised edge of the tray substantially opposite to the rear upper raised edge;

a seated occupant in the chair, the seated occupant being able to physically reach the rear upper raised edge of the tray, and the outer upper raised edge of the tray being out of reach from the seated occupant;

a holder means for supporting items off of the tray;

a food item being supported on the holder means; and a clamp for attaching the holder means to a portion of the outer upper raised edge of the tray so that the holder means and the food item are out of reach and the food cannot be spilled by the sitting occupant of the chair.

2. The detachable device of claim 1, wherein the holder means includes:

a subtray for the food item, wherein positioning of the subtray being attached by the clamp to the portion of the outer upper raised edge of the tray prevents spillage of the food item by the sitting occupant.

3. The detachable device of claim 1, wherein the holder means further includes:

an opening for supporting a food holder selected from at least one of a bottle, a glass and a jar, wherein positioning of the holder means being attached by the clamp to the portion of the outer upper raised edge of the tray prevents spillage of the at least one of the bottle, the glass and the jar, by the sitting occupant.

4. The detachable device of claim 1, wherein the chair is selected from at least one of: a highchair, a car seat, and a stroller.

5. A detachable device for trays that are pre-attached to seats, the device being out of reach to occupants sitting in the seats, comprising in combination:

a seat having a tray attached in front of the seat, the tray having a rear upper raised edge adjacent to the front of the seat, and an outer upper raised edge of the tray substantially opposite to the rear upper raised edge;

an occupant sitting in the seat, the seated occupant being able to physically reach the rear upper raised edge of the tray, and the outer upper raised edge of the tray being out of reach from the seated occupant;

a holder means for supporting items off of the tray, the holder means for supporting items selected from at least one of: food; liquid and utensils , on the holder means; and a clamp for attaching the holder to a portion of the outer upper raised edge of the tray, wherein the holder means and the supported items are out of reach from the sitting occupant.

6. The detachable device of claim 5, wherein the holder means further include:

a first space for supporting the utensils;

a second space for supporting the food; and a third space opening for supporting food liquid holders selected from at least one of a bottle, a glass and a jar, wherein locating the spaces on the holder means being attached by the clamp to the outer upper raised edge of the tray prevents spillage of the utensils, the food and the food holders, by the sitting occupant.

7. The detachable device of claim 5, wherein the holder means includes an accessory-tray for supporting the at least one of the food, the liquid and the utensils, wherein the location of the accessory-tray being attached by the clamp to the upper raised edge of the tray prevents spillage of the at least one of the food, the liquid and the utensils, by the sitting occupant.

8. The detachable device of claim 5, wherein the selected from at least one of: a highchair, a car seat, and a stroller.

9. A method for attaching subtrays for supporting foods, beverages and utensils to existing trays attached to occupied chairs, so that the supported foods, beverages and utensils are out of reach from persons in the occupied chairs, comprising the steps of:

providing a chair and a seated occupant, the chair having an existing tray attached to and in front of the chair, the tray having a rear upper raised edge adjacent to and in reach of the sitting occupant, and the existing tray having a outer upper raised edge opposite to the rear. upper raised edge, the outer upper raised edge being substantially out of reach from the seated occupant of the chair;

attaching a holder to a portion of the outer upper raised edge of the existing tray so that the holder extends away from the seated occupant, and is out of reach from the seated occupant; and positioning items in the holder to be out of reach from the seated occupant, the items being selected from at least one of: food, beverage, and a utensil, wherein the items within the holder remain out of reach from the seated occupant.

10. The method of claim 9, wherein the step of attaching includes the steps of:

hooking a curved surface of a clamp attached to the holder about the portion of the outer upper raised edge of the existing tray.

11. The method of claim 9, further comprising the step of:

feeding the at least one of the food and beverage items, to the seated occupant in the chair.

12. The method of claim 9, wherein the step of positioning the items includes the step of:

preventing spillage of the at least one of: food, beverage, and a utensil, by the positioning of the items in the holder out of reach from the seated occupant.

13. A method of attaching a subtray device for trays that are pre-attached to seats so that the subtrays are out of reach to occupants sitting in the seats, comprising the steps of:

providing a seat with an existing-tray pre-attached in front of the seat, the existing-tray having a rear upper raised edge adjacent to the front of the seat, and an outer upper raised edge of the existing-tray substantially opposite to the rear upper raised edge;

sitting an occupant in the seat, the sitting occupant being able to physically reach the rear upper raised edge of the existing-tray, and the outer upper raised edge of the tray being out of reach from the sitting occupant;

attaching an accessory-tray to a portion of the outer upper raised edge of the existing-tray for extending the accessory-tray away from the sitting occupant;

supporting items on the accessory-tray, the items selected from at least one of food and beverages, wherein the sitting occupant is prevented from spilling the items since the items are out of reach to the sitting occupant.

14. The method of claim 13, wherein the step of attaching includes the steps of:

wrapping a curved surface of a clamp attached to the accessory-tray about the portion of the outer upper raised edge of the existing tray, so that the accessory-tray remains out of reach to the sitting occupant.

* * * * *

UNITED STATES PATENT AND TRADEMARK OFFICE

CERTIFICATE OF CORRECTION

PATENT NO. : 6,484,989 B1 
DATED : November 26, 2002
INVENTOR(S) : Connery

It is certified that error appears in the above-identified patent and that said Letters Patent is hereby corrected as shown below:

Column 8,
Line 28, after "occupant of the chair" insert -- , the clamp having an upper member with a lower facing curved surface for hooking and wrapping about the outer upper raised edge of the tray and a lower member for stabilizing the holder means with the tray so that the holder means does not move relative to the tray --

Column 9,
Line 31, after "the sitting occupant" insert -- , the clamp having an upper member with a curved surface for wrapping about the upper raised edge of the tray and a lower member for stabilizing the holder means with the tray so that the holder means does not move relative to the tray --
Lines 31-36, after "occupant of the chair" delete "attaching a holder to a portion of the outer upper raised edge of the existing tray so that the holder extends away from the seated occupant, and is out of reach from the seated occupant" and insert -- wrapping a curved surface of a clamp attached to a holder about the portion of the outer upper raised edge of the existing tray; and
stabilizing a bottom portion of the clamp to the existing tray with a lower portion of the clamp, so that the holder does not move relative to the existing tray --
Line 37, after "positioning", delete "items" and insert -- an item --
Line 38, "the items" has been deleted, and -- the item -- inserted.

Column 10,
Lines 14-15, "device for trays that are pre-attached to seats so that the subtrays are out of reach to occupants sitting in the seats" has been deleted, and -- to an existing tray that is pre-attached to a seat so that the subtray is out of reach to an occupant sitting in the seat -- inserted.
Line 17, delete "a seat" and insert -- the seat --
Line 17, delete "an existing tray" and insert -- the existing tray --.
Lines 27-28, delete "attaching an accessory tray to a portion of the outer upper raised edge of the existing-tray for extending the accessory-tray away from the sitting occupant;" and insert -- hooking a curved surface of a clamp attached to the subtray about the portion of the outer upper raised edge of the existing tray, so that the subtray remains out of reach to the sitting occupant;
Stabilizing a bottom portion of the clamp to the existing tray with a lower portion of the clamp, so that the sub-tray does not move relative to the existing tray; and --
Delete lines 30-33, and insert -- supporting an item on the sub-tray, the item selected from at least one of food and a beverage, wherein the sitting occupant is prevented from spilling the item since the item is out of reach to the sitting occupant. --
Line 34, before "selected", -- chair is -- has been inserted.

UNITED STATES PATENT AND TRADEMARK OFFICE

CERTIFICATE OF CORRECTION

PATENT NO. : 6,484,989 B1 
DATED : November 26, 2002
INVENTOR(S) : Connery

It is certified that error appears in the above-identified patent and that said Letters Patent is hereby corrected as shown below:

Column 14,
Line 34, delete “attaching” and insert -- hooking --
Line 35, delete “steps” and insert -- step --
Line 36, delete “a” (both occurrences) and insert -- the -- (both occurrences)

Signed and Sealed this

Eighteenth Day of November, 2003

JAMES E. ROGAN
*Director of the United States Patent and Trademark Office*